United States Patent [19]

Eklund

[11] 4,446,187

[45] May 1, 1984

[54] SHEET ASSEMBLY AND METHOD OF MANUFACTURING SAME

[75] Inventor: Nils O. Eklund, Halmstad, Sweden

[73] Assignee: Nordiskafilt AB, Halmstad, Sweden

[21] Appl. No.: 247,775

[22] Filed: Mar. 26, 1981

[30] Foreign Application Priority Data

Apr. 1, 1980 [SE] Sweden ..... 8002483

[51] Int. Cl.[3] ..... B32B 3/10

[52] U.S. Cl. ..... 428/136; 134/383 A; 162/358; 428/131; 428/137; 428/138; 428/234; 428/246; 428/284; 428/300; 428/423.1

[58] Field of Search ..... 428/131, 134, 136, 138, 428/139, 140, 234, 235, 246, 252, 423,1, 137, 284; 162/358; 139/383 A; 34/243 F

[56] References Cited

U.S. PATENT DOCUMENTS 3,695,988 10/1972 Steigerwald ..... 428/138

4,206,258 6/1980 Balcar ..... 428/138

*Primary Examiner*—James J. Bell

*Attorney, Agent, or Firm*—Kane, Dalsimer, Kane, Sullivan & Kurucz

[57] ABSTRACT

The present invention relates to a sheet assembly with a permeability at least to gaseous media, as well as a method for manufacturing same.

The object of the present invention is to produce a sheet assembly which may be used as a forming fabric, press fabric and/or drying fabric, including as a press felt or drying felt.

This object is achieved in that a sheet assembly according to the present invention is characterized by a foil (1) of a substantially liquid impermeable material which is coordinated with a reinforcement structure (3) which is disposed wholly or partially within the foil (1) and is permeable to gas and possibly also to liquid, at least the foil (1) displaying substantially vertical through-channels (2).

9 Claims, 14 Drawing Figures

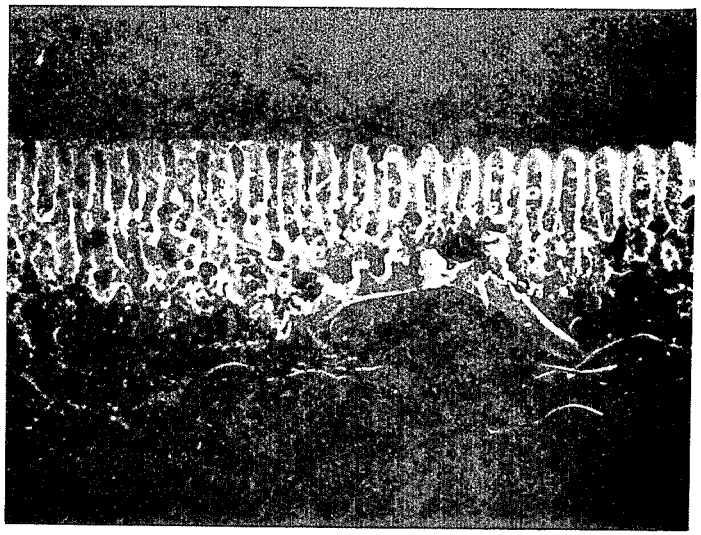
Fig. 9
Fig. 10
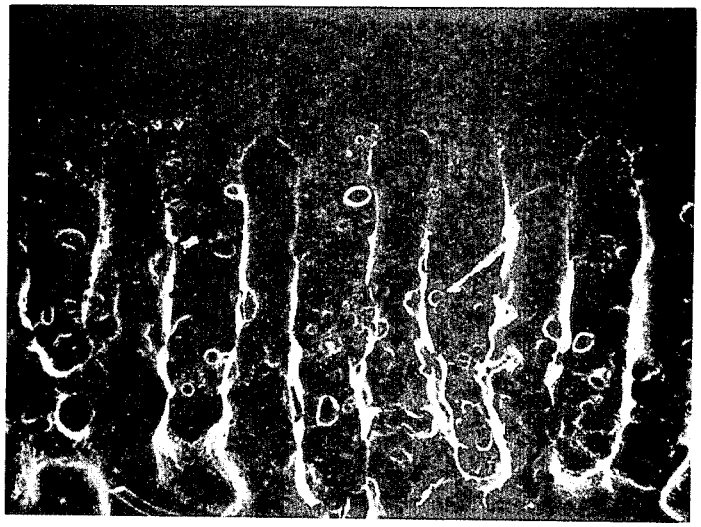

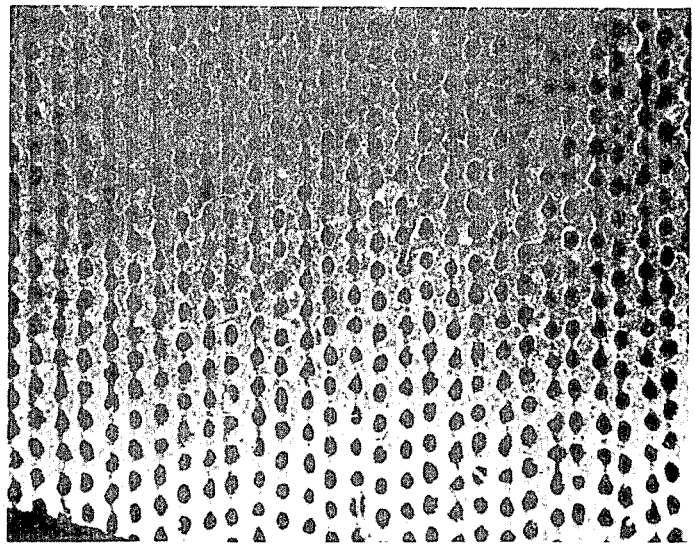
Fig. 11
Fig 12
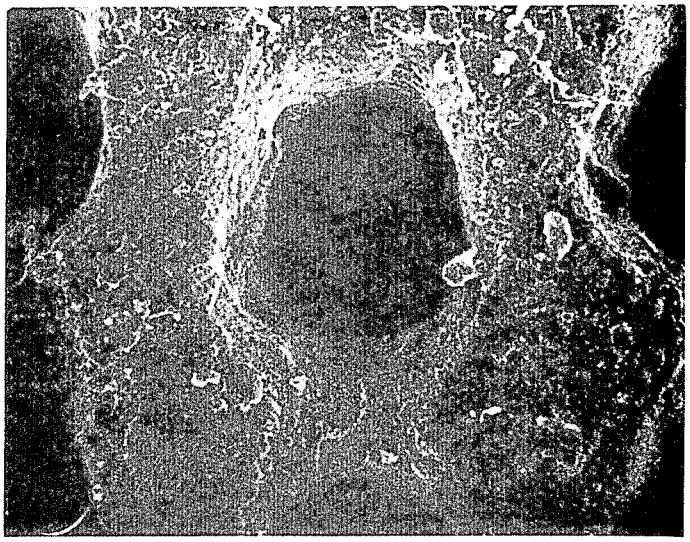

SHEET ASSEMBLY AND METHOD OF MANUFACTURING SAME

FIELD OF INVENTION

The present invention relates to a sheet assembly which is permeable at least to gaseous media, and to a method for manufacturing an assembly of this kind.

Such a sheet assembly is extremely versatile in its applications and in its fields of use. However, it is particularly within the paper-manufacturing industry that such sheet assemblies are extremely useful. The sheet assembly according to the present invention is particularly useful as a porous belt for dewatering fibre webs within the paper, cellulose and similar industries, but the sheet assembly according to the invention may also be used to separate solid particles from liquids and gases.

BACKGROUND OF THE INVENTION

In the manufacture of e.g. paper, a fibre web is formed by feeding fibres which are uniformly distributed in water onto or between forming fabrics or by allowing them to be taken up by a fabric-coated cylinder immersed in a tray. The forming fabric consists of a textile fabric of metal or synthetic-fibre yarns. The forming fabric serves two major functions, viz. to separate the fibres from the water and to form the fibres in a manner ensuring that an even and continuous fibre sheet is formed. The interstices between the yarns in the textile fabric form drainage channels through which the water is discharged and consequently these yarn interstices must not be too large since if they are the fibres might be entrained with the water and carried to the so-called white water. The density and surface properties of the fabric are factors which directly determine the quality of the finished paper. Uneven dewatering and uneven fabric surface give rise to irregular fibre formation, and this, in turn, influences the properties of the paper, such as the marking tendencies. Experiments have also been carried out with forming fabrics in the form of perforated plates, but for various reasons these have not found extensive application. The continuous fibre sheet obtained on the forming fabric has a comparatively high moisture content which is reduced by pressing and drying the sheet in the pressing and drying sections. Because of the high energy costs, it is desirable that as great amounts as possible of the moisture are removed in the press section, whereby the heating costs in the drying section can be kept at a minimum. In the pressing operation, the fibre web is compressed between two rollers together with one or several press felts and/or press fabrics. The nature of these is such that the water pressed from the fibre web penetrates into and partly through the felt. The press felt should both protect the fibre web during the pressing operation and lead off the water from the fibre web. The surface structure of the resulting paper is largely dependent on the pressing operation, which in turn is dependent upon the evenness of the press felt. The majority of press felts consists of a base fabric to which is needled a fibre batt. The fibre batt is produced by carding and has in itself a certain degree of unevenness which is amplified by the needled rows which arise in the basic fabric during the needling operation. To produce the best paper quality possible it is necessary that the side of the press felt facing the paper web is as even and finely porous as possible, while at the same time the back should be highly capable of leading-off and removing the water.

Attemps have been made to increase the permeability of the felt and its capacity to absorb moisture by providing in at least one fibre layer a moisture storage in the form of angularly inclined channels. Such channels are produced by melting of the fibre materials. Although this measure may impart improved dewatering properties, the problem nevertheless remains concerning the surface structure of a fibre product. Although at the present time the needled fibre batt gives the best and most even-fibred structure it does not solve the problems caused by streaks formed by the needles or other unevenness in the surface structure that have an effect on the evenness in the pressing operation and result in an undesirable coarseness of the paper surface. Moreover, fibre material structures display irregular, randomly located holes which give the structure or the press felt an uncontrollable porosity which may vary in different parts of the felt. Attempts have been made to grind the surface of fibre structures for the purpose of improving the surface evenness, but this grinding or smoothing operation has given rise to other inconveniences.

Also in the drying section, felts or fabrics are used for the purpose of pressing the fibre web or paper web against heated cylinders. The degree of drying and drying capacity in this section depend upon the evenness of the pressure with which the sheet is pressed against the cylinder and consequently the surface evenness of the felt or fabric is of great importance also in the drying section.

The purpose of the present invention thus is to provide a sheet assembly which may be used as a forming fabric, press fabric and drying fabric, including as a press felt and a drying felt. Prior-art forming fabrics have a surface with knuckles which protrude above the textile structure, bend and again turn downwards. Irrespective of how evenly these knuckles are distributed, it is desirable to produce and use a dewatering device having as even a surface as possible. It is, moreover, desirable that the porosity is as even as possible in order to achieve even dewatering and even formation of the fibre web when the sheet assembly is used as a forming fabric.

Prior-art press felts having a fibre fibrous structure are not very capable of withstanding the dynamic compression which occurs to a great extent in paper making machines in which the press felt is run through several million revolutions while being exposed to heavy loads. This leads to compression of the press felt and an increase of its density. The compression and density of the felt are also caused by weakening of the textile fabric structure, which consists of a large number of intersecting mono- and multifilament threads.

Evenness of the compression pressure also plays a decisive part in the surface structure of the paper as also in the dewatering of the sheet in the press nip. Even if a fibrous structure is ground or smoothed, it will nevertheless display a certain unevenness, which leads to a reduced dewatering effect and to a coarser surface structure in the finished paper. The surface unevenness of the felt or the fabric also increases the possibility for chemical attacks, soiling etc. It is thus desirable to produce a felt or a fabric which possesses as even a surface as possible.

Furthermore, in order to ensure maximum dewatering evenness, it is desirable to provide a high degree of controlled porosity and to be able to predetermine as far as possible the location of the pores. The term "pores" as used herein relates to moisture conductor means. In the majority of fibrous structures incorporating so-called needled felts, it is impossible to avoid that the needles cause agglomeration of fibres upon needle penetration through the batt layer.

In the past, the production of particularly press felts involves a long series of low-production, inexact processes, such as is for example the case in the manufacture of batts. For this reason it is desirable both to reduce the number of processes involved and to improve the accuracy of the processes.

SUMMARY OF THE INVENTION

The technical problems outlined above are solved and a great number of the needs discussed above are met in the sheet assembly according to the subject invention, which assembly is characterised in that a foil of a substantially liquid-impermeable material is coordinated with a reinforcement structure which is permeable at least to gas, and in that at least the foil displays substantially vertical through-channels.

Preferably, the reinforcement structure is located on one side of the foil and is connected to the foil at least in the areas of the channel mouths. The foil preferably is formed with pores in the material intermediate the channels. Preferably, the reinforcement structure consists of a fabric of mono- and/or multifilament threads. The fabric may be provided with a fibre layer on at least one side. The fibres are preferably needled to the fabric.

The method of manufacturing a sheet assembly according to the present invention is characterised in that a foil of a substantially liquid-impermeable, thermoplastic material is fed together with a reinforcement structure of substantially thermoplastic material, through a laser perforator which forms discrete holes at least in the foil.

Conveniently the laser perforator is modulated in order to provide the desired depth of the holes as well as the desired configuration of the hole walls. By varying the advancement of the foil and the reinforcement structure through the laser perforator substantially discontinuous hole traces may be obtained.

A sheet assembly according to the present invention has numerous advantages. For instance, the surface of the side facing the paper web is very even without impairing the water-drainage capacity of the opposite side. By manufacturing the sheet assembly using the laser technique, one has found that a great number of cavities or voids are formed in the foil which give the sheet assembly a high degree of elasticity. The latter may be further improved by the selection of a suitable material in the starting foil. This material may advantageously be a plastics material of polyurethane type.

Apart from extraordinary surface evenness and excellent dewatering properties, the sheet assembly according to the present invention displays a considerably higher degree of strength than prior art sheet assemblies for identical applications. Sheet assemblies or felts and fabrics according to the present invention will therefore have a considerably longer serviceable life.

DESCRIPTION OF THE ACCOMPANYING DRAWINGS

The invention will be described in closer detail with reference to the accompanying drawings, wherein FIG. 1 is a schematic cross-section through a sheet assembly according to one embodiment of the present invention.

Figure 4A:
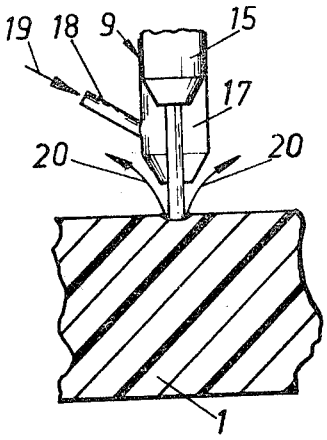
Figure 4B:
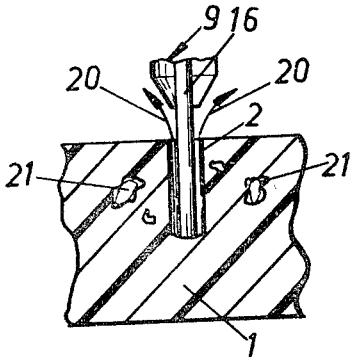
Figure 4C:
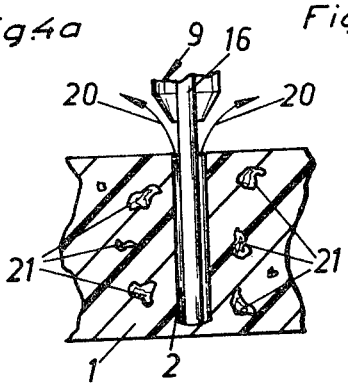
Figure 5:
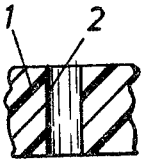
Figure 6:
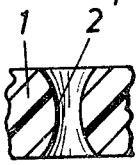
Figure 7:
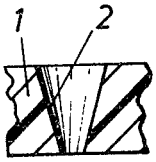
Figure 8:
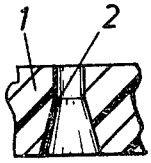

FIGS. 4*a*, 4*b* and 4*c* are schematic cross-sections showing the stages of manufacture of a hole in a sheet assembly according to the present invention.

FIGS. 5–8 are schematic cross-sections through a portion of the sheet assembly having different hole configurations.

Figure 1:
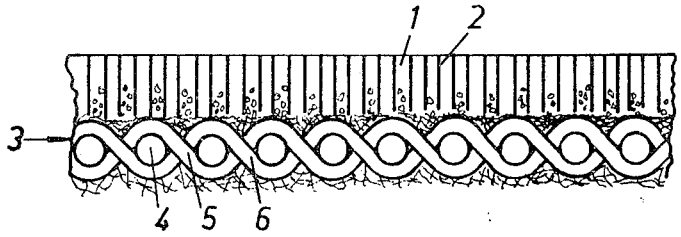

FIG. 9 is a photograph of a cross-section similar to that of FIG. 1, the photograph having been taken through an electron microscope having a magnification of approx. 20 times.

FIG. 10 shows a similar photograph to FIG. 9, but with a magnification of approx. 80 times.

FIG. 11 is a photograph of the surface of a sheet assembly according to one embodiment of the present invention, this photograph having been taken with an electron microscope, the magnification being approximately 20 times.

FIG. 12 is a similar photograph to FIG. 11, but with a magnification of approx. 280 times.

DETAILED DESCRIPTION OF A PREFERRED EMBODIMENT

As is more clearly apparent from FIG. 1 a sheet assembly according to one embodiment of the present invention consists of a foil 1 with through-holes or channels 2. On one side of the foil 1 is arranged a reinforcement structure 3 which in the illustrated embodiment consists of a fabric of staple fibres. The foil 1 and the reinforcement structure 3 are bonded to each other.

The foil 1 is preferably manufactured from a suitable plastics material, preferably of a thermoplastic type. The foil 1 preferably consists of polyurethane plastics. Plastics of this kind have proved to possess particular advantages which will be dealt with in greater detail below. Also the reinforcement structure or fabric 3 preferably consists of a plastics material and depending on the desired properties of the final sheet assembly it may be woven from monofilament warp threads or multifilament warp threads 4, and monofilament weft threads or multifilament weft threads 5. In the reinforcement structure or fabric 3, staple fibres 6 may also be included as is illustrated in FIG. 1, which fibres may be disposed in the form of one or more layers needled into the fabric 3.

As has been pointed out above, the foil 1 and the reinforcement structure 3 are bonded to each other, which is normally effected by means of fusion of the foil 1 and the reinforcement structure 3, but which may also be effected with the aid of some suitable adhesive or mechanical connection method. According to the invention, reinforcement of the bond between these two elements is effected in conjunction with the provision of the through-holes or channels 2 by means of a laser device as will be described in greater detail below with reference to FIGS. 2 to 4. This bond reinforcement alone may be sufficient to interconnect the foil 1 and the reinforcement structure 3.

Figure 2:
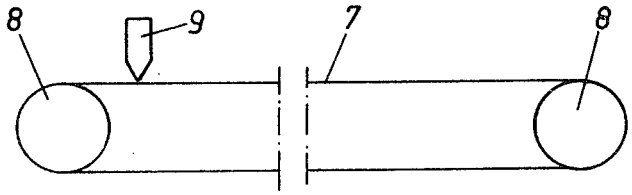
FIG. 2 is a schematic side elevation of an apparatus for manufacturing a sheet assembly according to the present invention.
Figure 3:
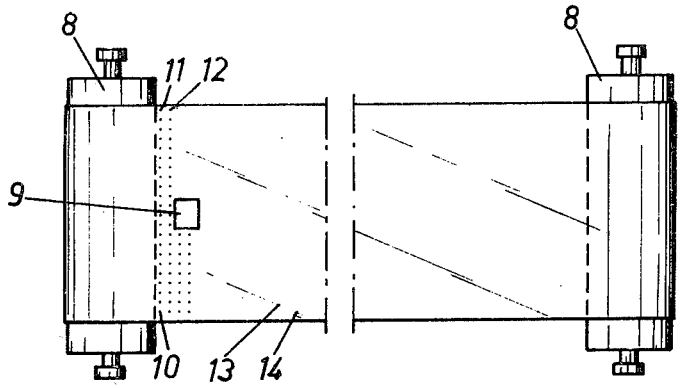
FIG. 3 is a top plan view of the apparatus of FIG. 2.

A method of manufacturing a sheet assembly according to the present invention will be described with reference to FIGS. 2 to 4. A belt 7 consisting of a reinforcement structure or fabric 3 and a foil 1 disposed thereon, is placed under tension between two rollers 8 in a perforation plant operating by means of a laser beam of a type known per se. The operative laser beam is obtained from a laser head 9 with, for example, a carbon dioxide laser known per se which is adjusted so as to be able to limit a beam which is modulated or pulsated in a desired manner via a known lens per se. These known parts are shown schematically in the drawings. The head 9 of the laser plant is supplied with the conventional equipment in the art for this purpose in a manner ensuring that recesses or channels 2 are created in the foil 1, which channels extend through the foil 1. The lighting time, beam diameter and intensity of the laser beam is such that the channels or holes 2 are given the desired width and depth. The depth is preferably adjusted to ensure that the laser beam does not penetrate through and does not affect, to any great extent, the reinforcement structure 3.

In this connection should be pointed out that in each channel or hole mouth 2 on the side turned to face the reinforcement structure or fabric occurs the fusion of the thermoplastics material as well as the bond reinforcement of the foil 1 to the reinforcement structure 3 as referred to above. This is more clearly apparent from FIGS. 9 and 10.

According to the present invention, it is desirable to effect perforation of the foil 1 and for this reason the head 9 is caused to move intermittently across the belt 7 and at each point of rest, to make a channel or hole 2. With reference to FIG. 3 the head 9 first makes the hole 10 in one row and continues moving across the belt 7 to the hole 11 at the end of the same row. Thereafter, the head is displaced by one row or row partition to make hole 12 and moves across the belt 7 to the opposite edge thereof. The head 9 continues to move in this manner across the belt 7, row by row, up to the hole 13, which may be regarded as the end of the coordinate table. At 14, a mark is made to serve as a guide by means of which the head 9 may be set in correct position after displacement of the belt 7 (to the left in accordance with FIG. 3). In this connection should be noted that after this displacement of the belt 7, the mark 14 should be set in the position corresponding to that of the hole 10 in FIG. 3, whereupon the sequence of movements of head 9 described above is resumed. It is also possible to displace the belt 7 stepwise over a distance corresponding to the spacing between the rows of holes.

The stages of manufacture of a hole or channel 2 is illustrated in detail in FIGS. 4*a* to 4*c*. In these figures, only the foil 1 is shown, however in this case foil 1 should be considered to represent the entire sheet assembly comprising both the foil 1 and the reinforcement structure 3. Furthermore, only a minor portion of the head 9 is shown, which head has a lens portion 15 which emits a laser beam 16 which impinges on the foil 1. A sleeve 17 encloses a portion of the laser beam 16, the sleeve having a connection 18. The sleeve is sealed to the head 9 and at its tip it has an aperture through which passes the laser beam 16. A high-pressure gas is fed into the sleeve 17, this gas being indicated by means of the arrow 19. The laser beam 16 melts the material of the foil 1 and, during the melting, gas generated in the hole-formation escapes, this gas escape being illustrated by means of the arrows 20.

FIG. 4*b* shows the laser beam 16 having penetrated further into the foil 1 and FIG. 4*c* shows a stage of even deeper penetration into the foil 1. Experiments have shown that without the sleeve 17 and the gas 19, the escaping gas 20 from the hole-formation would have had a detrimental effect on the lens 15 in the head 9. It has therefore proved necessary to provide a counteracting gas, which is achieved by means of the sleeve 17 and the gas 19. The gas 19 flows from the sleeve 17 simultaneously with the laser beam 16, thereby preventing the lens 15 from being attacked by the gas 20.

The deeper the laser beam 16 penetrates (FIG. 4*c*) into the foil 1, the higher will be the gas pressure in the channel being formed. The gas cannot escape as easily as before, for which reason the gas will to some extent diffuse into the foil 1. Because of the gas diffusion, gas blisters 21 form in the foil 1. The cavities or blisters 21 obviously will impart to the foil 1 a greater degree of softness and elasticity which in turn improves the capacity of the foil to withstand the great number of compressions to which it is exposed in the use of the sheet assembly as a press felt. It should be noted that the occurrence of gas blisters or cavities 21 has proved to be comparatively slight at the surface of the foil 1 closest to the laser head 9 but to be more frequent on the opposite surface and the region closest thereto. This is probably so because it is difficult for the gas to escape from partly formed holes 2 and therefore it penetrates into the material to a greater extent. However, this phenomenon can be controlled by means of the laser device.

Upon completion of the formation of a hole 2 in the foil 1, the latter will have been almost completely penetrated and fusion between the foil 1 and the reinforcement structure 3 takes place, whereby the foil and the structure are bonded to each other.

By the use of the laser device it is possible to produce holes or channels 2 of virtually any desired shape or configuration. This is true as regards the longitudinal configuration of the holes or channels as well as their transverse extension. FIGS. 5 to 8 illustrate a number of different hole configurations, and it is obvious that it is possible according to the present invention to combine according to wish any illustrated hole configurations both in one and the same hole and in different parts of the foil 1.

In FIGS. 9 to 11 are shown photographs of a prototype of a sheet assembly according to the present invention. From these photographs appear both the formation of the channels or holes 2 and, above all in FIG. 10, the occurrence of the per se desirable gas blisters 21 which would seem to improve to a great extent the elasticity of the foil 1 and its capacity to withstand an extremely large number of compressions without becoming excessively dense. FIGS. 9 and 10 show also the bond between the foil 1 and the reinforcement structure of fabric 3.

FIGS. 11 and 12 illustrate in greater detail the configuration of the holes or channels 2 and, in particular, the sectional configuration of the holes or channels. These Figures illustrate particularly the formation of the channels or holes 2 by means of a melting and fusing process.

As has been pointed out earlier the sheet assembly according to the present invention may be imparted almost any desired properties. Such desired properties include, above all, the permeability of the sheet assembly, by which is intended its capacity to allow passage-through of primarily gas but also of liquid, depending on the size of the holes 2. Despite the presence of the mouths of the holes 2 in the surface of the foil 1, the foil surface will be extremely even, especially when compared with prior-art press fabrics or press felts. Consequently, considerably higher paper qualities may be expected with the use of a sheet assembly according to the present invention in the press section of a paper making machine than with the use of a conventional fabrics and felts.

Dewatering of a paper web in a press depends on e.g. the pressure distribution between the felt and the paper. Felts possessing a high degree of evenness give a favourable pressure distribution and improve the transfer of water from the paper web to the felt. This distribution depends not only on the evenness of the fibrous surface but also on the structure of the base fabric within the felt, which can manifest itself at high pressures. It is possible to gain an idea of the pressure distribution by taking an impression by means of a planar press of the felt on thin cyano-acrylic-impregnated paper. The compression pressure is selected so as to correspond to the pressure in a papermaking machine press. Once the cyano-acrylate glue has hardened, the surface evenness may be measured by means of a surface evenness measurement device of the type conventionally used within the engineering industry. One has found that in the majority of felts the contour variations are within 200 μm for a new felt and as low as 60 μm for a felt which has been run-in evenly.

By adapting the film thickness, the film rigidity, the diameter and positions of the holes that are perforated in the film, as well as the structure of the reinforcement member or the carrier (the base fabric) it is possible, by means of a sheet assembly according to the present invention—which consists of a laser-perforated foil 1 arranged on a textile carrier—to obtain a dewatering belt possessing a very even pressure distribution. One reason therefor is that the surface evenness can be kept within very restricted limits. ±20 μm have been measured on impressions taken from experimental belts in which the film may be selected so as to bridge any unevenness in the carrier.

I claim:

1. A sheet assembly for dewatering fiber webs comprising:

a layer of substantially liquid-impermeable material in contact with said webs; and a reinforcing structure;

said sheet having substantially vertical through-channels formed at least through said layer, said through-channels being adapted to lead water away from said fiber webs when the layer is placed in contact with said fiber webs.

2. An sheet assembly according to claim 1, wherein said reinforcement structure is located on one side of said layer and is connected to said layer at least in the regions of the mouths of said channels.

3. An sheet assembly according to claim 1, comprising pores in the layer material between said channels.

4. An sheet assembly according to claim 1, wherein said reinforcement structure consists of a fabric of monofilament threads.

5. An sheet assembly according to claim 4, wherein said fabric is provided with fibres on at least the side facing one side of said layer.

6. A sheet assembly according to claim 4, wherein said fabric is provided with fibres at least on the side facing one side of said layer, said fibres needled to said fabric.

7. An sheet assembly according to claim 1, wherein said reinforcement structure consists of a fabric of multifilament threads.

8. An sheet assembly according to claim 7, wherein said fabric is provided with fibres on at least the side facing one side of said layer.

9. An sheet assembly according to claim 7, wherein said fabric is provided with fibres on at least the side facing one side of said layer, said fibres needled to said fabric.

* * * * *